US012232640B2

(12) United States Patent
DeCristoforo

(10) Patent No.: US 12,232,640 B2
(45) Date of Patent: Feb. 25, 2025

(54) BUOYANT CUP HOLDER

(71) Applicant: Mark DeCristoforo, Stoneham, MA (US)

(72) Inventor: Mark DeCristoforo, Stoneham, MA (US)

( * ) Notice: Subject to any disclaimer, the term of this patent is extended or adjusted under 35 U.S.C. 154(b) by 0 days.

(21) Appl. No.: 18/319,699

(22) Filed: May 18, 2023

(65) Prior Publication Data

US 2024/0382025 A1 Nov. 21, 2024

(51) Int. Cl.
*A47G 23/02* (2006.01)

(52) U.S. Cl.
CPC ..... *A47G 23/0216* (2013.01); *A47G 2200/02* (2013.01)

(58) Field of Classification Search
CPC ..... A47G 23/0216; A47G 2200/02
See application file for complete search history.

(56) References Cited

U.S. PATENT DOCUMENTS

| | | | | |
|---|---|---|---|---|
| 3,533,529 | A | 10/1970 | Helbig | |
| 6,029,845 | A | 2/2000 | Mueller | |
| 6,085,926 | A | 7/2000 | Weiss | |
| 6,139,382 | A | 10/2000 | Eschbacher | |
| 6,253,950 | B1 | 7/2001 | Buck | |
| 6,607,090 | B1 | 8/2003 | Doerr | |
| 6,616,493 | B2 * | 9/2003 | Powell | A45F 5/02 206/427 |
| 8,215,515 | B2 | 7/2012 | Churchill | |
| D873,624 | S * | 1/2020 | Rogers | D7/619.1 |
| 11,382,442 | B2 * | 7/2022 | Storey-Knight | A47G 23/0216 |
| 2004/0188450 | A1 * | 9/2004 | Marshall | B29C 44/0407 220/737 |
| 2005/0121457 | A1 * | 6/2005 | Wilson | A47G 23/0216 220/739 |
| 2006/0096872 | A1 * | 5/2006 | Oakes | A47G 23/0216 206/217 |
| 2006/0278769 | A1 * | 12/2006 | Pineda | A47G 23/0225 248/104 |
| 2008/0078788 | A1 | 4/2008 | Degges | |
| 2014/0110412 | A1 * | 4/2014 | Johnson | A47G 23/0216 220/560 |
| 2016/0324350 | A1 * | 11/2016 | Rogers | A47G 23/0216 |
| 2017/0020319 | A1 * | 1/2017 | Detweiler | A47G 23/03 |
| 2018/0199742 | A1 * | 7/2018 | Rogers | A47G 23/0216 |
| 2019/0077290 | A1 * | 3/2019 | White | B60N 3/108 |
| 2020/0275792 | A1 * | 9/2020 | McCutchen | A47G 23/02 |
| 2021/0007522 | A1 * | 1/2021 | Stuart | A47G 23/0225 |

FOREIGN PATENT DOCUMENTS

| | | |
|---|---|---|
| AU | 2005100097 | 2/2005 |
| JP | 2003-61806 | 4/2003 |
| WO | 2008115106 | 9/2008 |

* cited by examiner

*Primary Examiner* — Don M Anderson
(74) *Attorney, Agent, or Firm* — Lambert Shortell & Connaughton; David J. Connaughton, Jr.; Justin P. Tinger

(57) ABSTRACT

A buoyant, floatable drink holder is provided. The drink holder may be a disc shaped body which defines a central opening to hold a cup. The drink holder is wide enough relative to the cup diameter such that it stabilizes the cup when floating in the water and prevents it tipping to the side. As configured, the drink holder allows a user to place a cup in the holder and place the cup and holder in the water, whereby the holder floats the cup on the water and stabilizes it for convenient and reliable access to a drink while in the water without having to constantly hold the drink.

16 Claims, 4 Drawing Sheets

BUOYANT CUP HOLDER

BACKGROUND OF THE INVENTION

The present disclosure relates generally to cup holding and stabilizing devices. More particularly the present disclosure relates to a buoyant cup holder which is able to float on the surface of water to hold a cup in an upright position, even against waves and other disruptions.

When swimming and otherwise enjoying a pool, lake, river, ocean and the like, a refreshing drink is often desired. Drinks provide refreshment, hydration, and are generally enjoyable and can extend the amount of time one can remain in the body of water. However, holding a drink while swimming or enjoying the water is cumbersome. At least one hand is employed holding the drink, which makes moving around in the water difficult. Further, holding a drink for an extended period of time is inconvenient, and becomes uncomfortable and tiring. Having a place to rest the drink while in the water is highly desired.

Further, in many instances, drinks are provided in rugged and insulated "tumbler" cups which often also include covers. These tumblers can be fairly heavy, making extended holding of the cups particularly inconvenient and tiring. Moreover, in instances where metal tumblers are used, holding can become uncomfortable due to the cold feeling of the metal.

Therefore, what is needed is a device that may safely hold a drink on or in the water to prevent it from spilling, sinking, getting lost, and the like.

SUMMARY OF THE INVENTION

The subject matter of this application may involve, in some cases, interrelated products, alternative solutions to a particular problem, and/or a plurality of different uses of a single system or article.

In one aspect, a drink holder is provided. The drink holder has a body formed in a disc shape, the body formed of a buoyant material having a density less than that of water. The body defines an inner opening extending from a top surface to a bottom surface of the body. This inner opening is formed of a continuous sidewall about the inner opening and sized to frictionally receive a cup. The drink holder body further comprises a tapered outer wall such that a top surface of the body has a greater diameter than a bottom surface of the body, and as such the body forms a conical frustum shape.

In another aspect, a drink holder is provided. The drink holder has a body formed in a disc shape, the body formed of a buoyant material having a density less than that of water. The body defines an inner opening extending from a top surface to a bottom surface of the body, the top and bottom surfaces being parallel to each other. This inner opening is formed of a continuous sidewall about the inner opening and sized to frictionally receive a cup. The drink holder body further comprises a tapered outer wall such that a top surface of the body has a greater diameter than a bottom surface of the body, and as such the body forms a conical frustum shape. The body, in this aspect, is formed of a closed cell foam making it particularly water-resistant and limiting water-logging. A cup is frictionally positioned within the inner opening to connect it to the drink holder such that a sidewall of the cup abuts the continuous sidewall of the body. As positioned, a bottom of the cup is positioned adjacent to the bottom surface of the body and a top of the cup is positioned adjacent to the top surface of the body. The body further defines an opening extending from a top surface to one of the tapered outer wall and the bottom surface and comprises a tether connected to the body through the opening.

In yet another aspect, a method of holding a drink while floating in a body of water is provided. The method involves placing a metal tumbler in an inner opening of a drink holder, the drink holder having a buoyant body surrounding the inner opening, wherein the body has a diameter that is at least twice as large as the diameter of the inner opening, such that the body allows the metal tumbler to float on the water in a stable manner. The metal tumbler is secured against a frictional force between the tumbler and a continuous sidewall which defines the inner opening. The drink holder and tumbler assembly is then placed in the water allowing it to float such that the drink holder are floating stably in the water. Finally, a tether of the body can be connected to a secure object such as a user.

DETAILED DESCRIPTION OF THE INVENTION

Figure 1:
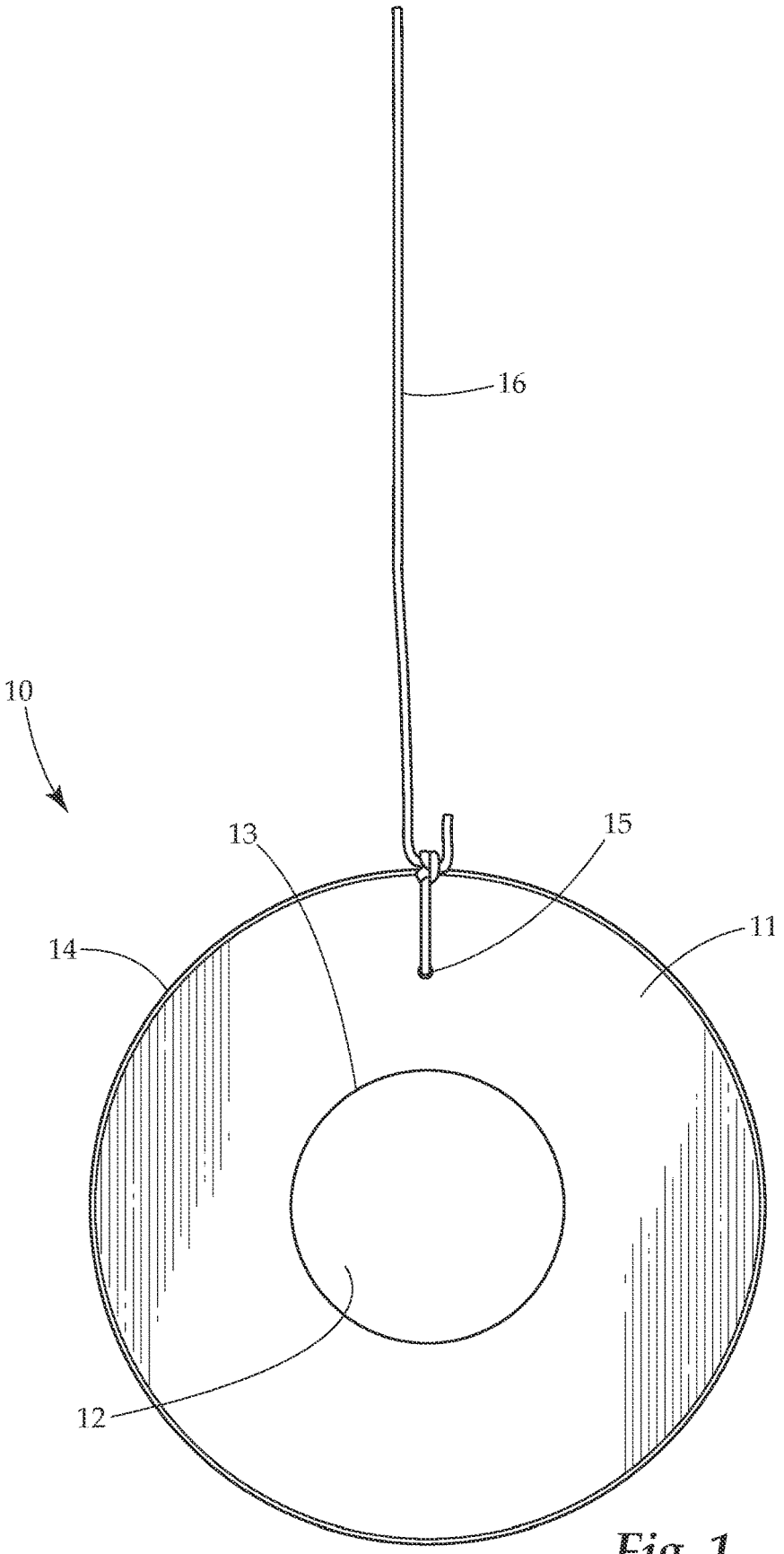
FIG. 1 provides an elevation view of an embodiment of the present disclosure.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

Generally, the present disclosure concerns a buoyant, floating cup holder (referred to herein both as a buoyant cup holder, and floating cup holder) which is configured to hold a cup in a central opening, and configured to provide a floating, stable platform which can hold the cup approximately perpendicular to a surface of the water which can also withstand substantial waves without tipping over to prevent spilling of the drink or getting water in the drink within the cup.

The floating cup holder is formed generally of a foam body which has a circular cross section and which defines a continuous, circular inner opening sized to receive a cup. The body, in most embodiments is formed of a buoyant material such as foam. Sidewalls at the edge of the circular inner opening may be straight (perpendicular to a flat top surface of the body), or may be slightly tapering to match a shape of an outer wall of a common cup such as a Solo® cup, insulated tumbler, and the like. In many cases, cups have a tapering diameter. For embodiments having straight sidewalls of the inner opening, this allows the more narrow portion of the cup at the bottom to pass through the opening completely, while the larger diameter area near the top of the cup is frictionally engaged with the top portion of the sidewall closer to the top surface of the body. This allows for the device to hold somewhat differently sized cups, as the tapering will allow cups of varying sizes to fit at different depths. Typically, the inner opening is sized such that the frictional engagement between wall and cup occurs about ⅔ of the way to the top of the cup. This allows a portion of the top of the cup to extend above the water, while also a portion of the cup sits into the water providing ballast and cooling the drink.

The circular cross-sectional shape of the body is advantageous because it provides an equal stability in all directions. In use cases such as a pool, lake, ocean, and the like, it is common for waves and water disruptions to come from many different and unpredictable directions. Accordingly, by providing a circular body, the drink float device is able to be stable in all directions.

Outer sidewalls of the body may, in most embodiments, taper inward such that the top surface outer diameter is greater than a bottom surface outer diameter. This defines the body, in these embodiments, as a conical frustrum shape. Tapering outer walls unexpectedly provides improved stability. The tapering width forms a downward facing wall which, when contacted by the water, pushes the body upward away from the water's surface. Moreover, the greater buoyant volume due to increased diameter of the body at the top compared to the bottom means that as the body sinks into the water, a greater buoyant force pushes it back up compared to a straight walled body. Tapering angle may vary, but in one embodiment, the angled wall is at a 45 degree angle. In another embodiment, the angled wall is angled between 30-60 degrees outward angle relative to the bottom surface of the body. In a particular embodiment, the wall may be angled at 60 degrees. Further still, the tapering edge allows for the body to sink into the water slightly rather than floating right on top of the water. By sinking in slightly, the device provides additional stability similar to how ballast works on a boat, and allows for smaller waves and disruptions of the water to move around the device without excess rocking.

The body may vary in size depending on intended use without straying from the scope of this disclosure. In one embodiment, the body may have a top outer diameter of approximately 9.5 inches and a bottom outer diameter of approximately 8.5 inches. The diameter of the inner opening may also vary depending on desired cup to be held. In one embodiment, the inner opening may have an approximately 3 inch diameter. In another embodiment, the inner opening may have an approximately 3.5 inch diameter. In a particular embodiment, the body may have a thickness of approximately 1 inch. In one embodiment, the body may have a ratio of top surface outer diameter to inner opening diameter of 3.17-2.7:1. It has been unexpectedly found that this ratio range allows for the proper amount of stability to the cup and float body while in water. Importantly, the drink holder is wide enough relative to the cup diameter such that it stabilizes the cup when floating in the water and prevents it tipping to the side. In another embodiment, the body has a diameter at least three times the diameter of the inner opening, such that on each side of the inner opening, there is a portion of the body that is equal to the width of the inner opening. In another embodiment, the body may have a diameter that is at least twice the diameter of the inner opening. In a particular embodiment, a body may have a large diameter inner opening, and may further include a spacer which acts as an adapter for a smaller cup. The spacer may have a continuous outer wall which may frictionally fit within the inner opening and define a smaller continuous inner opening to hold the smaller cup. In another embodiment, the spacer may have tabs or a flange extending from a top surface which abut a top surface of the body when the spacer is fitted into the larger inner opening. This spacer may also define a smaller continuous inner opening to hold the smaller cup.

For a sturdy, long lasting device, it is desirable to have a continuous wall around the inner opening. The continuous wall prevents undesired deformation of the foam, which leads to its degradation fairly quickly. The term continuous wall is used herein to describe a non-interrupted wall both around the top and bottom surfaces of the body, and also continuous inner sidewalls. In some cases, the cup may have two diameters with a step-wise narrow section at the bottom. Commonly this is when a tumbler is sized to fit in a cup holder but also provide a large volume. In such cases, the inner opening is sized to receive the larger top area diameter.

In preferred embodiments, the body is formed of a foam. More preferably a closed cell foam so as to prevent the foam from getting water-logged during use in the water. In certain embodiments, the foam may be a soft closed cell foam which allows for a flexible, soft body which also may deform slightly to tightly receive a cup frictionally fitted within the inner opening. In particular embodiments, the foam of the body may be selected to be 2LB XLPE cross-linked polyethylene or other similar closed-cell, fine-celled and resilient foam. In another embodiment, the body may be coated with a waterproof or water-resistant coating separate from the foam and around the outer edges of the body.

In a further advantageous embodiment, the body, having a cup removed, can be used as a frisbee. The tapering outer edge of the body, in a frisbee mode of use, adds lift to the frisbee when thrown by urging air passing across it downward. In such embodiments, the body material is selected to be light enough and resilient enough to be thrown and caught as is done with a frisbee.

Turning now to FIG. 1, an elevation view of an embodiment of the buoyant drink holder is shown. The drink holder 10 is formed as an approximately disc shaped, frustoconical body 11. The body 11 has a top outer edge 14 and defines an inner opening 12 sized to receive a cup to be frictionally held against inner walls 13. Further, a tether 16 is connected to the body 11 by passing through opening 15. Opening may be straight in shape and pass from a top surface of the body to the bottom surface, may be angled to pass through top surface and to the side wall, or may be curved to open at the top surface and side wall or bottom surface. As can be seen, aside from the inner opening 12, and tether opening 15, the body 11, in this embodiment, has a continuous top and bottom surface without any other openings. This may improve stability and limit water splashing through any openings which may get into the cup being held by the drink holder 10.

Figure 2:
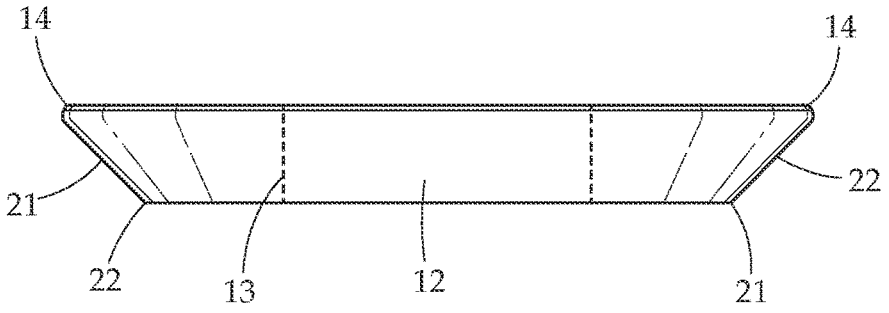
FIG. 2 provides a side view of another embodiment of the present disclosure.
Figure 3:
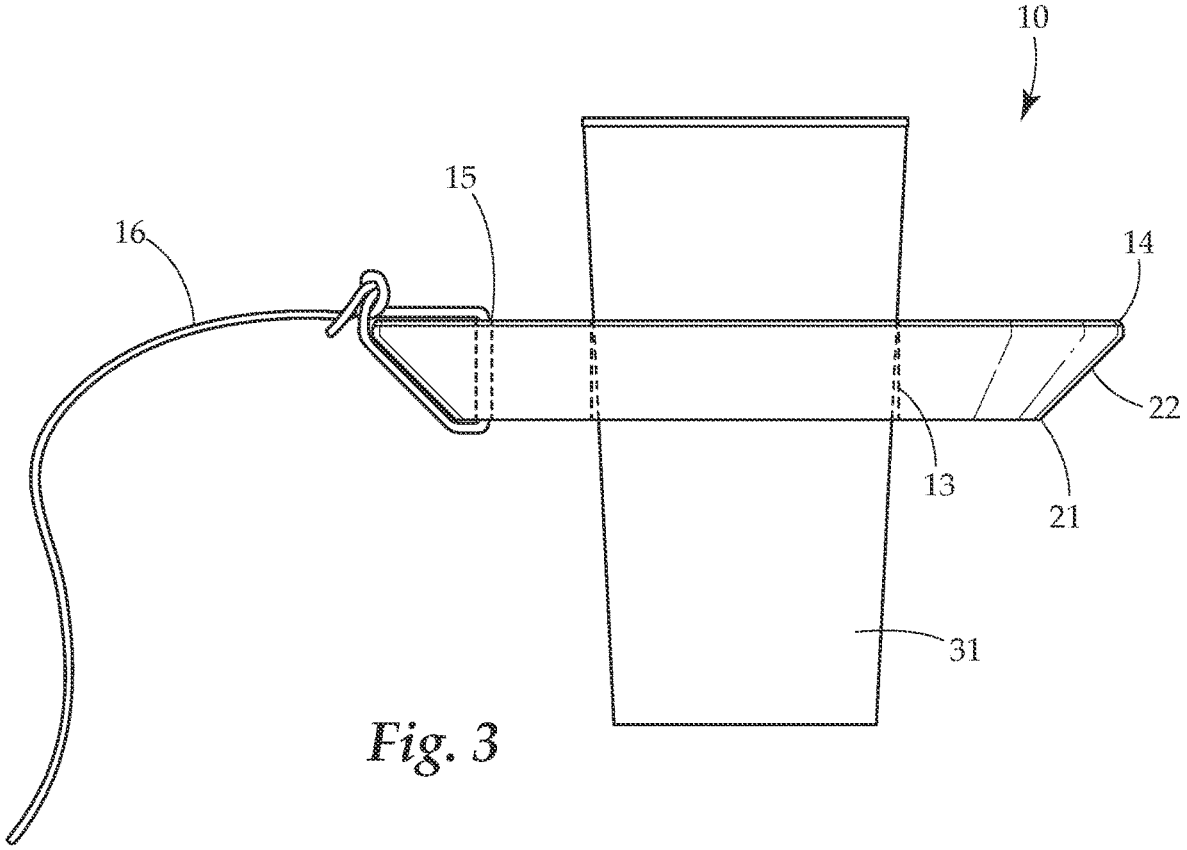
FIG. 3 provides a side view of yet another embodiment of the present disclosure.

FIGS. 2 and 3 show a side view of an embodiment of the floating drink holder. The drink holder 10 body can be seen from a side edge, which shows its tapering side wall 22 and frustoconical shape. The side wall 22 is angled between top edge 14 and bottom edge 21. The inner opening 12 extends from top to bottom surface of the floating drink holder 10 which is defined by circular sidewall 13. In the embodiments shown, the sidewall 13 is perpendicular to the top surface of the body 11, though in other embodiments, the sidewall may taper inward to be more narrow at the bottom than at the top, so as to match a taper of the cup indented to be placed therein. As seen in FIG. 3, a cup 31 frictionally fits into the inner opening 12 and abuts against sidewalls. Inner opening 12 will vary in size depending on the specific cup to be held by the cup holder. In typical embodiments, the floating drink holder is designed to hold one sized cup or a small range of cup sizes. The tether 16 connects to the body 11 via curved opening 15 which opens at top surface of the body 11 and at the sidewall 22. As discussed above and as can be visualized in the figures, the tapering shape provides enhanced stability to the drink held perpendicularly to the top surface of the body 11, and by virtue of its buoyant materials, can float on the water with the drink.

Figure 4:
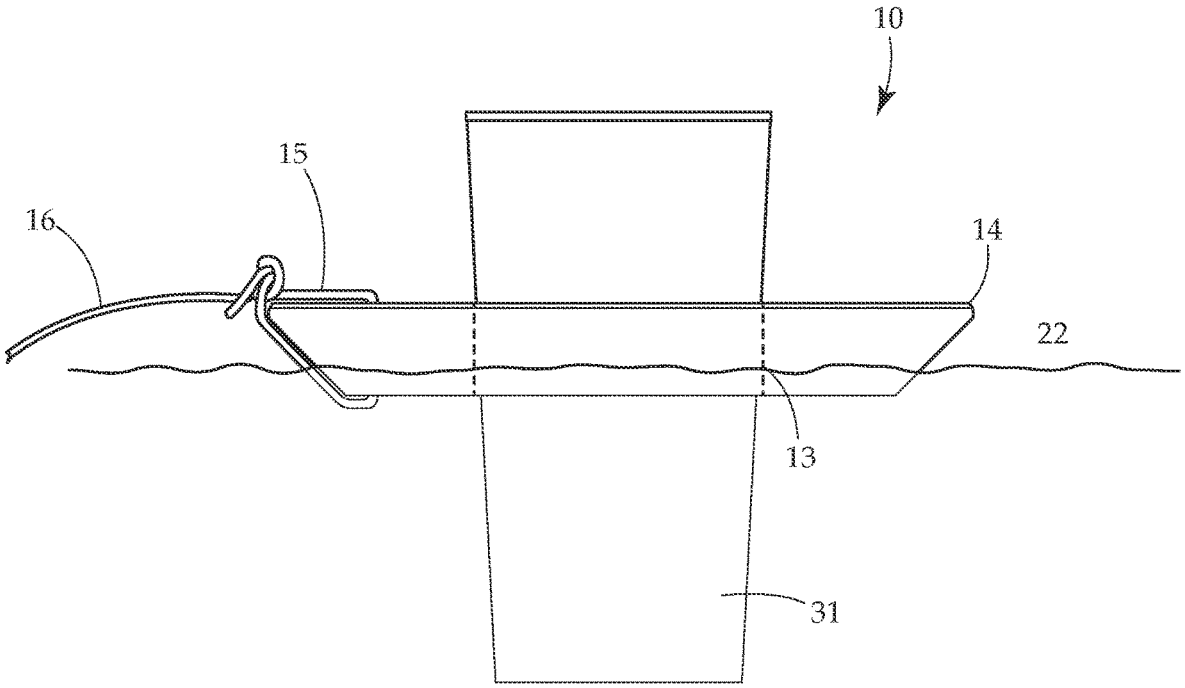
FIG. 4 provides a side view of still another embodiment of the present disclosure floating on the water and holding a cup.
Figure 6:
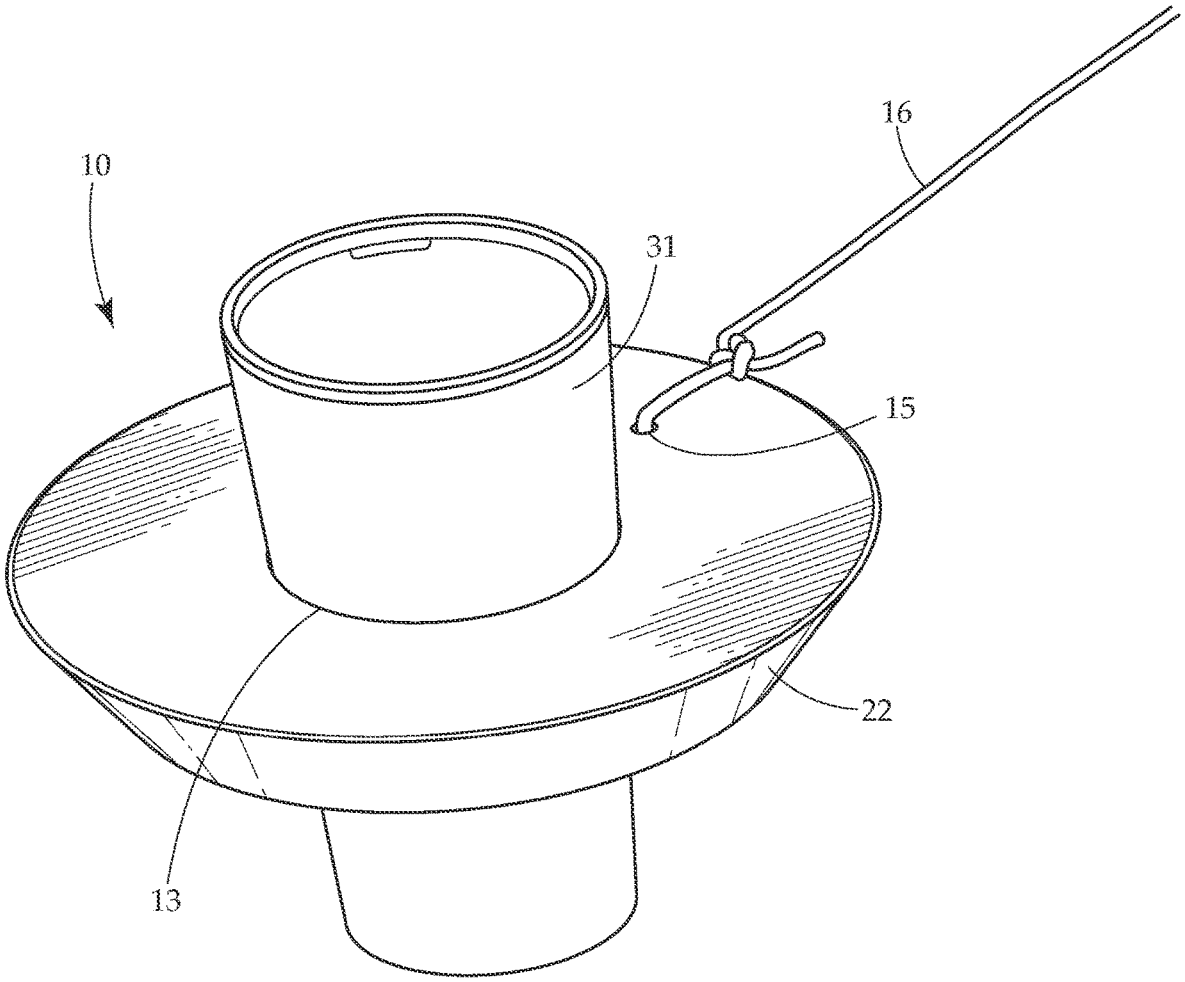
FIG. 6 provides a perspective view of another embodiment of the present disclosure floating on water and holding a cup.

FIGS. 4 and 6 provide views of an embodiment of the floating cup holder positioned on the water and having a drink supported and held therein. The cup holder 10 has body 11 which defines the inner opening 12 and circular sidewall 13. Cup 31 frictionally fits into the inner opening 12 such that its top is elevated above the top surface of the body 11. The cup holder 10 is floating in water 41. As can be seen, the angled sidewall 22 allows the body 11 to sit somewhat in the water below the surface, while if a wave comes, the tapering wall 22 causes more displacement of water and also receives a force of the wave upward against it, further lifting the cup holder 10 and cup 31 therein up and out of the water and facing away from the wave, thereby protecting the cup and its contents.

Figure 5:
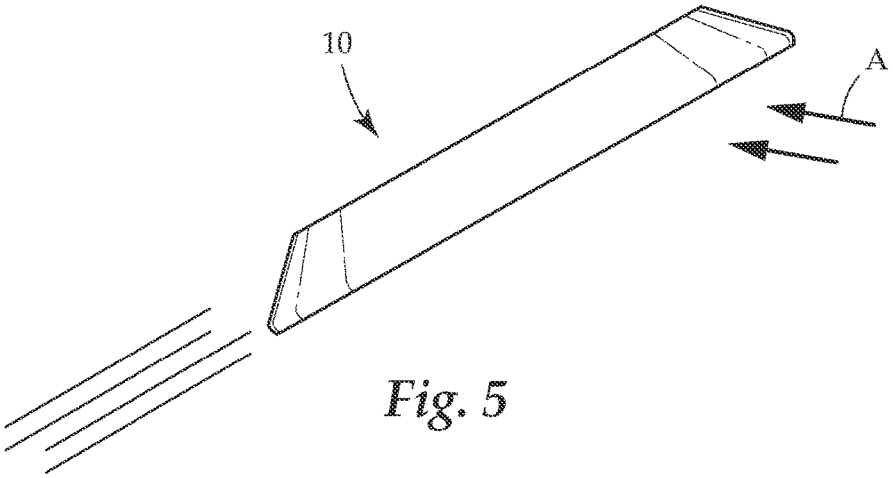
FIG. 5 provides a view of the device being used in a frisbee mode.

FIG. 5 provides a view of the cup holder in a frisbee operational mode. The cup holder 10 has any cup removed from it. By virtue of the body foam material selection, it has an ideal shape and weight for use as a frisbee which are enjoyable and popular toys in pool and other water settings. Moreover, the tapering sidewall 22 adds extra lift when thrown, deflecting air A downward to urge the body upward.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth.

What is claimed is:

1. A drink holder comprising:

a body formed in a disc shape, the body formed of a buoyant material having a density less than that of water, the body defining a first inner opening extending from a first top surface to a bottom surface, the first inner opening formed of a continuous sidewall about the first inner opening;

wherein the first inner opening is sized to receive a cup;

wherein, the first top surface is flat;

wherein, a side wall of the first inner opening is perpendicular to the first top surface;

wherein, the first inner opening is operable to receive a cup with an inwardly tapered side surface;

wherein, a lower, narrower portion of the cup is able to pass the first inner opening completely, and an upper, larger-diameter portion of the cup is able to frictionally engage with a top portion of the side wall of the first inner opening;

wherein, a frictional engagement between the cup and the side wall of the first inner opening occurs ⅔ from a bottom to a top of the cup;

wherein, when the cup is held by the first inner opening and the body is floating in water, a top portion of the cup extends beyond the water, and a bottom portion of the cup sits into the water, providing cooling to drink in the cup;

wherein the body further comprises a tapered outer wall such that a first top surface of the body has a greater diameter than a bottom surface of the body.

2. The drink holder of claim 1 wherein the body is formed of a foam.

3. The drink holder of claim 2 wherein the foam is a closed cell foam.

4. The drink holder of claim 1 wherein the body further comprises a coating over an outer surface formed of a material different from a material of the body.

5. The drink holder of claim 1 wherein the body further defines an opening extending from a top surface to one of the tapered outer wall and the bottom surface.

6. The drink holder of claim 5 further comprising a tether connected to the body through the opening.

7. The drink holder of claim 5 wherein the opening is straight.

8. The drink holder of claim 5 wherein the opening is curved.

9. The drink holder of claim 1 wherein the ratio of the diameter of the top surface of the body to the inner opening is approximately 3:1.

10. The drink holder of claim 1 wherein the ratio of the diameter of the top surface of the body to the inner opening is approximately 2.7:1.

11. The drink holder of claim 1 wherein the top surface of the body and the bottom surface of the body are parallel.

12. A drink holder assembly comprising:

a body formed in a disc shape, the body formed of a buoyant material having a density less than that of water, the body defining an inner opening extending from a top surface to a bottom surface, wherein the top surface and bottom surface are parallel, the inner opening formed of a continuous sidewall about the inner opening;

wherein the inner opening is sized to receive a cup;

wherein the body further comprises a tapered outer wall such that a top surface of the body has a greater diameter than a bottom surface of the body;

wherein the body is formed of a closed cell foam;

wherein, the top surface is flat;

wherein, a side wall of the inner opening is perpendicular to the top surface;

a cup frictionally positioned within the inner opening such that a sidewall of the cup abuts the continuous sidewall of the body;

wherein, a side wall of the cup tapers inwardly;

wherein, a lower, narrower portion of the cup is able to pass the inner opening completely, and an upper, larger-diameter portion of the cup is able to frictionally engage with a top portion of the side wall of the first inner opening;

wherein, a frictional engagement between the cup and the side wall of the inner opening occurs ⅔ from a bottom to a top of the cup;

wherein, when the cup is held by the inner opening and the body is floating in water, a top portion of the cup extends beyond the water, and a bottom portion of the cup sits into the water, providing cooling to drink in the cup;

wherein the body further defines an opening extending from a top surface to one of the tapered outer wall and the bottom surface; and further comprising a tether connected to the body through the opening.

13. A method of holding a drink in a body of water comprising:

placing a metal tumbler in an inner opening of a drink holder, the drink holder having a buoyant body surrounding the inner opening, wherein the body has a diameter that is at least twice as large as the diameter of the inner opening;

securing the metal tumbler against a frictional force of the tumbler against a side wall of the body which defines the inner opening;

wherein, a top surface of the drink holder is flat;

wherein, a side wall of the inner opening is perpendicular to the top surface;

wherein, the metal tumbler has an inwardly tapered side surface;

wherein, a lower, narrower portion of the metal tumbler is able to pass the inner opening completely, and an upper, larger-diameter portion of the metal tumbler is able to frictionally engage with a top portion of the side wall of the first inner opening;

wherein, a frictional engagement between the metal tumbler and the side wall of the first inner opening occurs ⅔ from a bottom to a top of the metal tumbler;

floating the drink holder and metal tumbler in the water such that the drink holder and metal tumbler are floating in the water;

wherein, when the cup is held by the inner opening and the body is floating in the water, a top portion of the metal tumbler extends beyond the water, and a bottom portion of the metal tumbler sits into the water, providing cooling to drink in the cup;

connecting a tether of the body to a secure object.

14. The method of claim 13 wherein the body is formed of a closed cell foam.

15. The method of claim 13 wherein the body further comprises a tapered outer wall such that a top surface of the body has a greater diameter than a bottom surface of the body.

16. The drink holder of claim 1, further comprising:

a spacer with a second inner opening smaller than the first inner opening, placed inside of the body;

wherein, the spacer has:

a continuous outer wall frictionally fitting with the first inner opening; or one or more tabs or a flange extending from a second top surface of the spacer abutting the first top surface.

* * * * *